US007318766B2

(12) United States Patent
Marine et al.

(10) Patent No.: US 7,318,766 B2
(45) Date of Patent: Jan. 15, 2008

(54) DOLL WITH STAND

(75) Inventors: Jon C. Marine, Fullerton, CA (US); Mark S. Wittenberg, Rossmoor, CA (US); Debbie Glassberg, Manhattan Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/018,365

(22) Filed: Dec. 20, 2004

(65) Prior Publication Data

US 2005/0191935 A1 Sep. 1, 2005

Related U.S. Application Data

(60) Provisional application No. 60/538,444, filed on Jan. 21, 2004.

(51) Int. Cl.
*A63H 3/00* (2006.01)
*A63H 3/20* (2006.01)
*A63H 11/00* (2006.01)

(52) U.S. Cl. ..... 446/359; 446/268; 446/330

(58) Field of Classification Search ..... 446/167, 446/169, 234, 268, 280, 298, 330–334, 359, 446/274, 277, 314, 354, 360, 367
See application file for complete search history.

(56) References Cited

U.S. PATENT DOCUMENTS 436,455 A * 9/1890 Crandall ..... 446/331
593,592 A 12/1897 Lyons
1,189,585 A 7/1916 Kruse
1,323,902 A * 12/1919 Obolewicz ..... 446/236
1,348,386 A * 8/1920 Wronowski ..... 446/265
1,380,107 A 5/1921 Keel
1,685,358 A 9/1928 Harcourt
2,100,486 A * 11/1937 Lohr ..... 446/83
2,115,533 A * 4/1938 Myers ..... 40/457
2,158,052 A * 5/1939 Berger ..... 446/303
2,813,371 A 5/1957 Tiebe
3,325,939 A 6/1967 Ryan et al.
3,475,853 A 11/1969 Adler
3,624,691 A 11/1971 Robson et al.

(Continued)

FOREIGN PATENT DOCUMENTS

EP 0150283 7/1984

(Continued)

OTHER PUBLICATIONS

U.S. Appl. No. 60/557,033, filed Mar. 25, 2004, Marine et al.

*Primary Examiner*—Eugene Kim
*Assistant Examiner*—Alyssa M Hylinski
(74) *Attorney, Agent, or Firm*—Kolisch Hartwell, et al.

(57) ABSTRACT

Embodiments of toy dolls and doll stands are disclosed, in which a user input applied to the doll or stand may generate motion in the stand and/or doll to animate the doll and/or stand. In some embodiments, a users' input motion may be stored in a compression or expansion member, such as a spring, and gradually released to actuate motion of one or more parts of the stand and/or doll. In some embodiments, the dolls and stands can be separate or for use with each other, the same stand usable for multiple dolls. In some embodiments, the doll may be powered to move independent of the stand.

9 Claims, 5 Drawing Sheets

U.S. PATENT DOCUMENTS 3,648,405 A 3/1972 Tepper
3,672,097 A * 6/1972 Gardel et al. ..... 446/352
3,699,712 A 10/1972 Handler et al.
3,740,894 A 6/1973 Howland et al.
3,859,751 A * 1/1975 Leblanc ..... 446/359
3,928,934 A 12/1975 Lewis et al.
3,955,309 A 5/1976 Noble
4,003,158 A 1/1977 Wolf et al.
4,038,775 A 8/1977 Sato
4,040,206 A * 8/1977 Kimura ..... 446/352
4,118,888 A 10/1978 Ogawa
4,127,251 A 11/1978 Sapkus et al.
4,170,840 A 10/1979 Ogawa
4,176,492 A 12/1979 Sims et al.
4,183,173 A 1/1980 Ogawa
4,186,515 A 2/1980 Ogawa
4,206,564 A 6/1980 Ogawa
4,217,726 A * 8/1980 Flicker et al. ..... 446/361
4,233,775 A 11/1980 Neufeld
4,297,806 A 11/1981 Ilkcagla
4,412,399 A * 11/1983 Abe et al. ..... 446/359
4,545,775 A 10/1985 Kim
4,571,206 A 2/1986 Mayer et al.
4,579,542 A 4/1986 Mayer et al.
4,596,532 A 6/1986 Cook et al.
D289,311 S 4/1987 Kuo
4,673,374 A 6/1987 Kelley
4,723,932 A 2/1988 Kelley et al.
4,801,285 A 1/1989 Yeu
4,824,416 A 4/1989 Chun-Hoi et al.
4,968,280 A 11/1990 Kelley
5,013,276 A * 5/1991 Garfinkel ..... 446/14
5,147,238 A 9/1992 Kelley et al.
5,273,479 A 12/1993 Chang
5,277,643 A 1/1994 Ejima
5,295,889 A 3/1994 Ejima
5,308,276 A 5/1994 Fogarty et al.
5,380,233 A 1/1995 Numoto
5,412,890 A * 5/1995 Fechter ..... 40/414
5,413,517 A * 5/1995 Kamijima ..... 446/354
5,516,314 A 5/1996 Anderson
5,525,086 A * 6/1996 Gentile et al. ..... 446/41
5,558,555 A * 9/1996 Kennedy ..... 446/359
5,727,717 A 3/1998 Vigne
6,124,541 A 9/2000 Lu
6,126,508 A * 10/2000 Chou ..... 446/358
6,171,169 B1 1/2001 Saunders
6,261,148 B1 7/2001 Robinson
2002/0127945 A1 9/2002 Cheng

FOREIGN PATENT DOCUMENTS

EP 1108454 8/1998
FR 2623725 A1 * 6/1989
GB 2354456 11/2000
JP 49-18956 2/1974
JP 50-037068 11/1975
JP 62-164092 7/1987
JP 63-103685 7/1988

* cited by examiner

DOLL WITH STAND

The present application claims priority to provisional patent application Ser. No. 60/538,444, titled DOLL WITH STAND", filed on Jan. 21, 2004, naming Jon C. Marine, Mark S. Wittenberg and Debbie Glassberg as inventors, the entire contents of which are incorporated herein by reference for all purposes.

BACKGROUND

Examples of known bendable dolls are found in U.S. Pat. Nos. 593;592; 1,189,585; 3,325,939; 3,624,691; 3,955,309; 4,233,775; and 5,516,314; and in publications JP49-18956 A; JP50 037068 B2; JP62-164092U; JP63-103685 A; EP1108454; GB2354456. Examples of known dolls with magnetic attachments are found in U.S. Pat. Nos. 4,038,775, 4,118,888, 4,170,840, 4,176,492, 4,183,173, 4,186,515, 4,206,564, 5,277,643, 5,295,889, 5,380,233, 5,727,717, and 6,171,169. The disclosures of all of the patents and publications listed in this paragraph are incorporated herein by reference.

SUMMARY

The present disclosure relates generally to toy dolls and doll stands to be used with the dolls, where a user input applied to the stand generates motion in the stand and/or doll to animate the doll and/or stand.

The users' input motion is stored in a compression or expansion member, such as a spring, and gradually released to create motion in the stand and/or doll.

The advantages of the present disclosure will be understood more readily after a consideration of the drawings and/or the Detailed Description of Example Embodiments.

DETAILED DESCRIPTION OF EXAMPLE EMBODIMENTS

Figure 2:
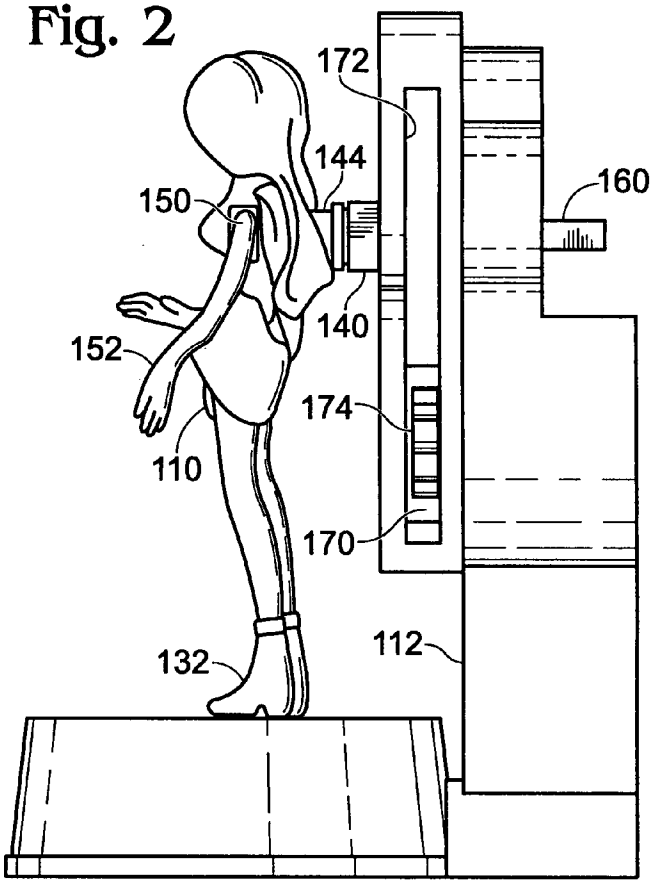
FIG. 2 shows a side view of the first example figure and stand with the figure coupled to the stand.

Various examples of three inch posable dolls and stands are described herein. However, the dolls and stands could be of a smaller or larger size, if desired. The dolls may be made from hard plastic, or alternatively be bendable, or combinations or sub-combinations thereof. In one example, the dolls can also be placed on animated stands, such as described below herein with regard to FIGS. 1-10.

Specifically, FIGS. 1-10 show various examples of dolls and stands that may be adapted to be coupled together, so that motion in the stand is transferred through a mechanism in the doll to allow motion of the doll, and/or transferred through a mechanism in the stand to allow motion of the stand, or combinations thereof. Thus, in one example, the dolls movement is dependent upon movement in the stand. In some examples, this provides for the opportunity to manufacture the doll with reduced cost, and/or achieve a doll that weighs less since its motion may be powered from the stand. Further, in this way, a simplified system may be obtained that allows for synchronous motion between the doll and stand. However, the dolls and stands can be separate or for use with each other. Further, in some examples, the same stand can be used for multiple dolls, and/or the doll may also be powered to move independent of the stand.

Referring now specifically to FIGS. 1-4, a first example embodiment of a doll 110 and stand is described. The doll 110 may be removably attached to the stand 112 via two foot pegs 130 (one for each foot 132 in one example, see FIG. 4) and a motion peg 140 protruding from the back (See FIGS. 2-4). The foot pegs 130 allow the doll 110 to remain attached to the stand 112 throughout motion sequences, yet allow a simple connection approach that allow for easy removal.

Figure 1:
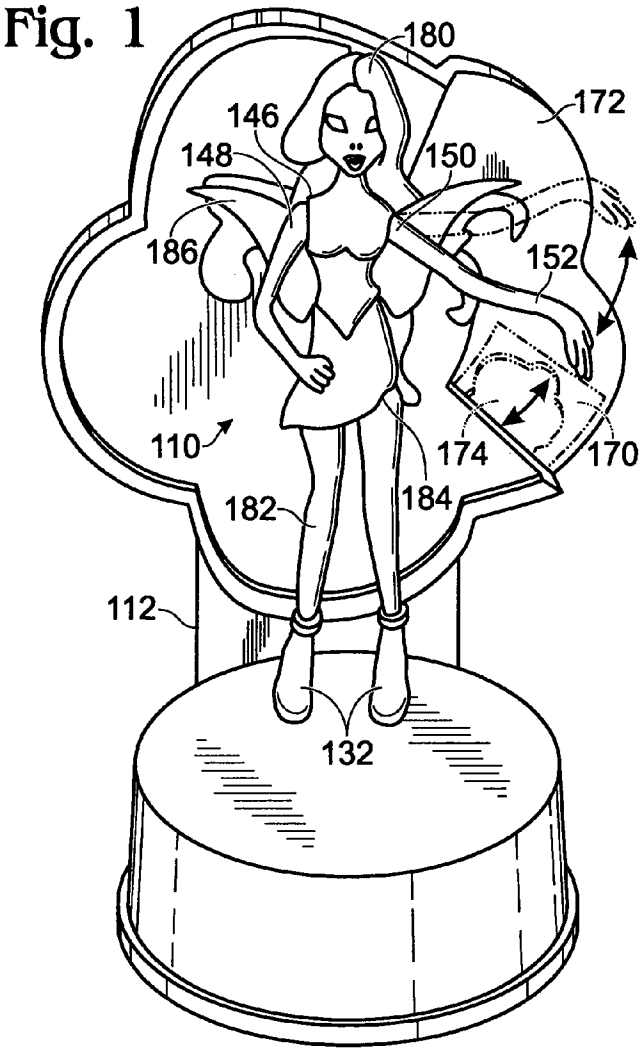
FIG. 1 shows a front view of a first example figure and stand with the figure coupled to the stand.

FIG. 1 shows a front view of the doll 110 removably attached to the stand 112 via the foot pegs and back peg. The doll may be made from hard plastic, with a singe degree of freedom rotary joint 146 at the right arm 148, allowing a user to position the arm in various positions. The left arm 152 is mounted to an internal mechanism via joint 154 in the doll to translate up and down vertical motion of the back peg into rotary motion of the left arm. Specifically, in one example, motion of tab 160 may be first stored in a storage device in the stand, and then translated to motion of peg 140, where motion of peg 140 is transferred to create motion of arm 152 about joint 150.

In another example, motion generated by the tab 160 in the back of the stand 112 (see FIGS. 2-3) may be translated into up and down motion of mating peg 140 to the back leg of the doll, as well as to the back panel of the stand 112 to expose a clear printed pattern of flowers 174 from the back of the stand on panel 170, timed with the arm 152 raising and lowering (shown by the dash-dot lines of FIG. 1). The panel 170 (hidden in FIG. 1) rotates in to fill cutaway section 172, although the dashed line shows the panel in a partially exposed position (dashed line). In other words, panel 170 may be hidden within the stand, and when motion is generated, motion of the panel 170 and arm 152 are coordinated together, as shown by the arrows. In one example, the panel 170 rotates into and out of view revealing flowers 174, while the arm 152 raises and lowers.

The doll can, in one example, have an internal cam mechanism (or any other type of gear or motion transfer device) to translate the motion of the peg to motion of the arms, legs, hair, etc.

The doll 110 may have hard plastic hair 180, and may have moveable or bendable legs 182 and hip joints 184. Further, the doll 110 may have permanently attached, or removable wings 186. In one example, the doll 110 may include any and each of the features of the examples described in U.S. Provisional Patent Application No. 60/538,444, forwarded on Jan. 7, 2004, titled DOLL, naming Jon C. Marine, Mark S. Wittenberg, and Debbie Glassberg as inventors, the entire contents of which are incorporated herein by reference in their entirety.

FIG. 2 shows a side view of the doll 110 removably attached to the stand 112. The single degree of freedom rotary shoulder joint 150 of the left arm 152 is illustrated. It may be a pinned joint in one example. However, other joints may also be used. The figure shows the tab 160 in the back of the stand which is actuated by the user to initiate the coordinated motion of the doll and stand. Further, cutaway section 172 is shown which allows the timed appearance of the flowers 174 with the motion of the arm 152 via a movable panel 170 in the stand 112.

Figure 3:
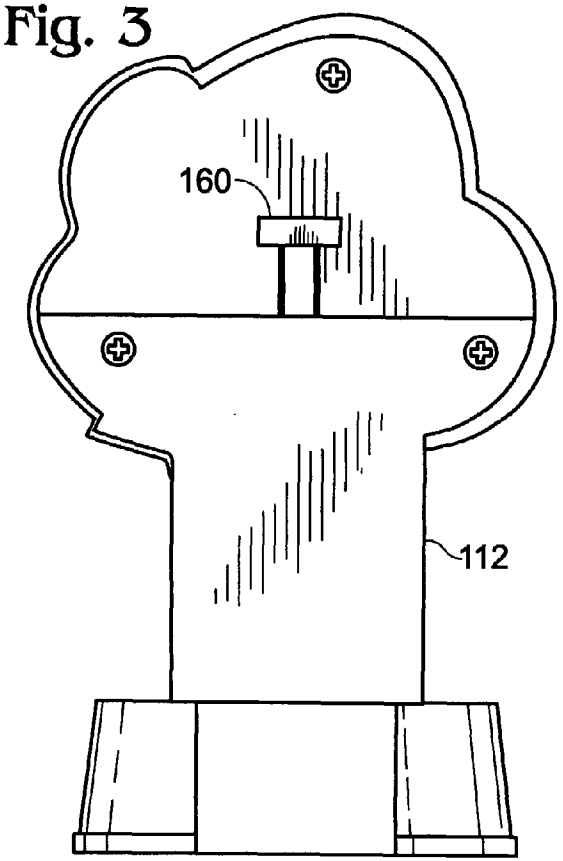
FIG. 3 shows a rear view of the first example stand.

FIG. 3 shows a rear view of the stand and the tab 160 in the back of the stand 112. The tab 160 can be actuated by a user's hand, as shown below. In one example, by pressing down, the user compresses (or tensions) a resilient member (such as a coiled spring), although no motion of the stand or doll yet occurs. Then, as the user releases the applied force to the tab 160, the stored energy is released to create motion. In one example, a speed governor (not shown) is used to control the rate of release of the spring's energy, to create the desired motion. This structure can also be used in any of the various examples described below.

Figure 4:
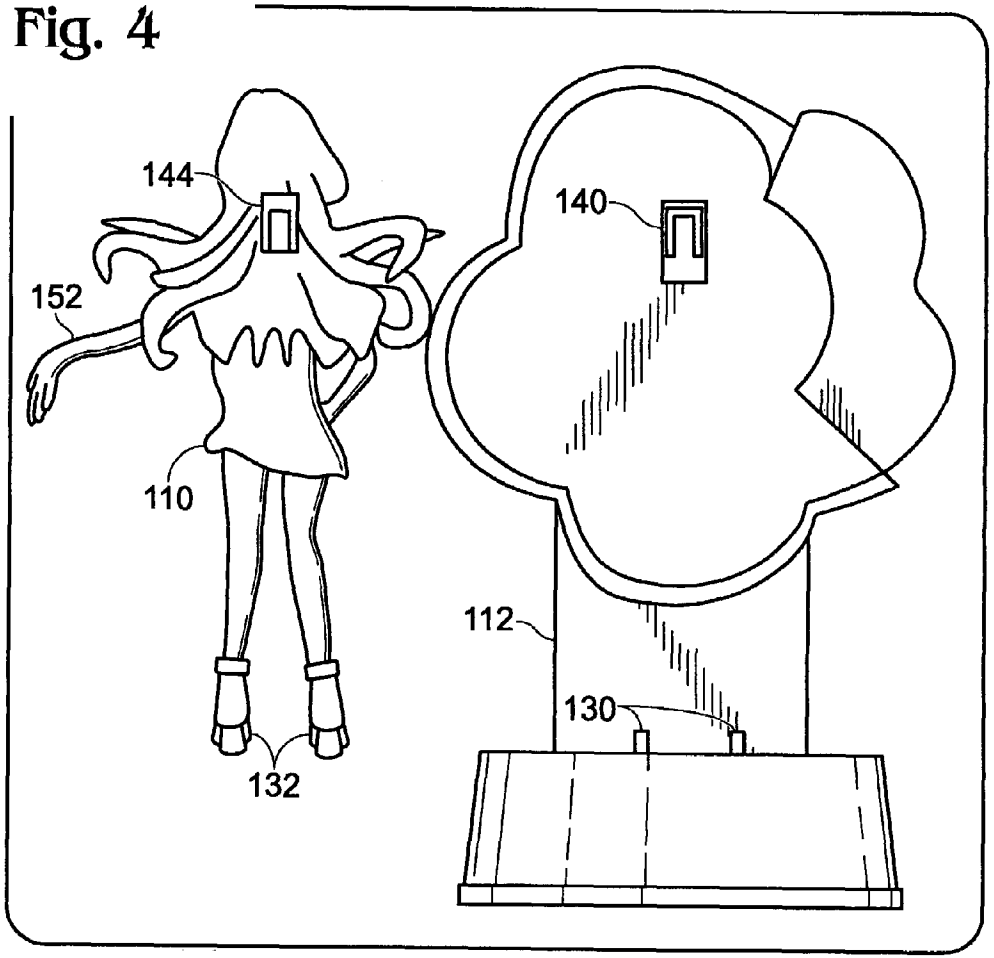
FIG. 4 shows a front view of the first example stand and a rear view of the first example figure.

FIG. 4 shows a front view of the stand with a mating female peg 140 that can move up and down. Further, it shows a rear view of the doll 110 with a corresponding mating male tab 144 to be inserted in the female peg 140 in the stand. Further, FIG. 4 again shows the cut-away area 172 in the right 'side of the stand that allows the movable panel 170 to reveal the flowers 174 in synchronism with the arm 152 movement.

In one example, progressive motion of the doll 110 on the stand 112 is obtained via actuation by a user's hand. Specifically, up and down motion of the left arm, timed with the counter clock-wise, and then clock-wise, motion of the flower panel 170 can be used, where panel 170 substantially fills the cut-away area 172. Note that the panel 170 can have various designs other than flowers. Further note that the panel can have a greater or lesser degree of motion, as can the left arm.

Figure 6:
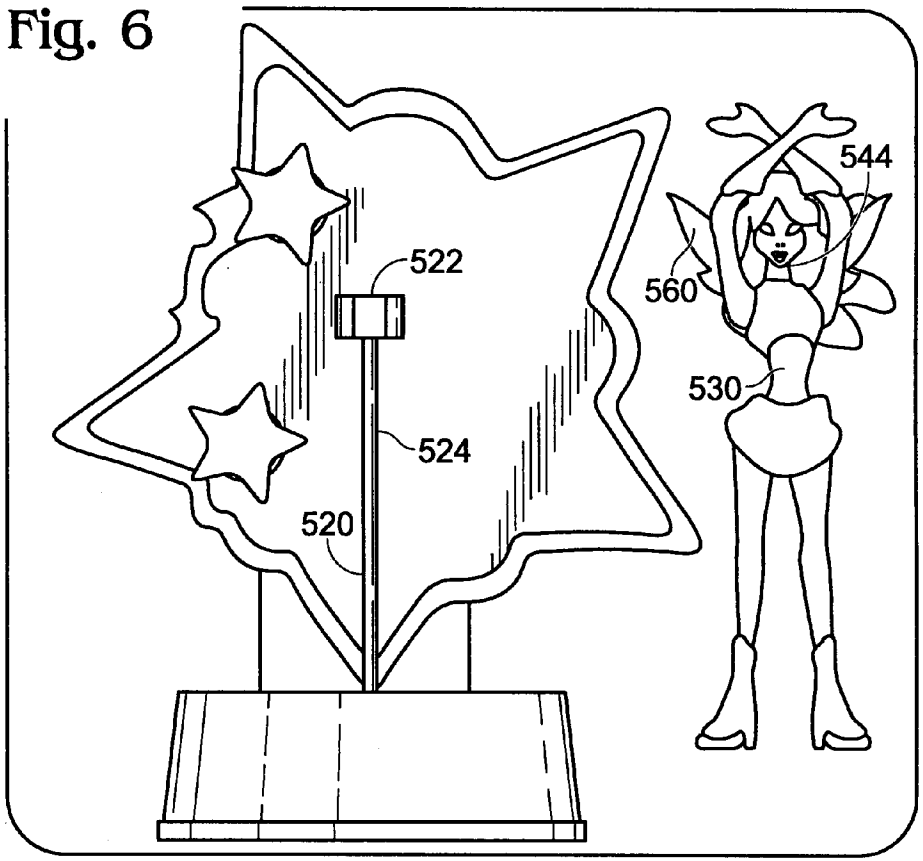
FIG. 6 shows a front view of the second example stand and a front view of the second example figure.
Figure 5:
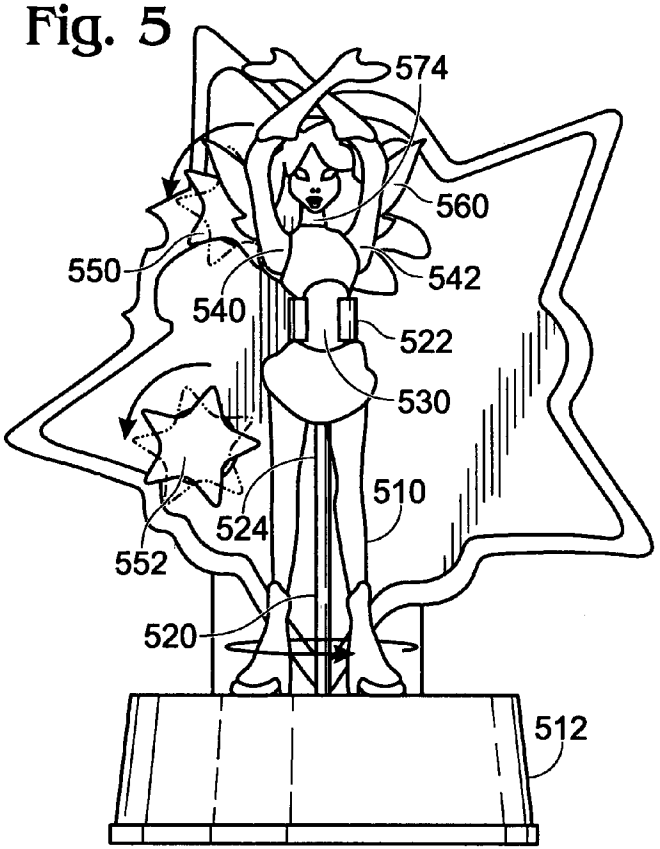
FIG. 5 shows a front view of a second example figure and stand with the figure coupled to the stand.

Referring now specifically to FIGS. 5-6, a second example embodiment of a doll 510 and stand 512 is described. The doll 510 may be removably attached to the stand via a post 520 with a c-shaped plastic ring 522. FIG. 5 shows a front view of the doll 510 removably attached to the stand via the post with the ring around a waist area 530 of the doll, where the doll is adapted to be removably coupled to the ring. The post may have an arch 524 to allow the doll's legs and hip to be positioned in line with the body, even when attached to the post.

In one example, the waist area 530 of the doll 510 is formed of smooth plastic into a cylindrical shape of such a diameter so that the hole in the c-shaped ring 522 can bend apart to capture the cylinder, as well as release the cylinder. The doll may be made from hard plastic, with a single degree of freedom rotary joint at the right and left arms (540, 542), allowing a user to position the arms in various positions. Likewise, the legs can be made from hard plastic with a single degree of freedom joint to allow positioning of the legs in different positions. Further, the neck joint 544 may allow rotary motion of the head.

Motion generated by a tab (not shown) in the back of the stand (see above) may be translated into rotary motion of the center area of the stand with the post, timed with rotary motion of the stars 550, 552 on the left side of the figure. This motion of the stars can simulate spinning of the stars, timed with spinning of the doll on the stand, as shown by the arrows. Stand 512 may utilize similar components and mechanisms as described above with regard to FIGS. 1-4 and stand 112.

The doll 510 may have hard plastic hair, or soft synthetic hair, and may have moveable or bendable legs and hip joints, as noted above. Further, the doll 510 may have permanently attached, or removable wings 560. In one example, the doll 510 may include any and each of the features of the examples described in U.S. Provisional Patent Application No. 60/538,444, forwarded on Jan. 7, 2004, titled DOLL, naming Jon C. Marine, Mark S. Wittenberg, and Debbie Glassberg as inventors.

FIG. 6 shows a front view of the stand with the post and both stars in view. Further, it shows a front view of the doll 510. As noted above, in one example, after actuated by a user's hand, the stand (and post) rotate, timed with the motion of the rotating starts (which can both rotate counter clock-wise, clock-wise, or in different directions). In this example, the doll and post make two full circles of rotation, however a greater or lesser degree of rotation can be used.

Figure 7:
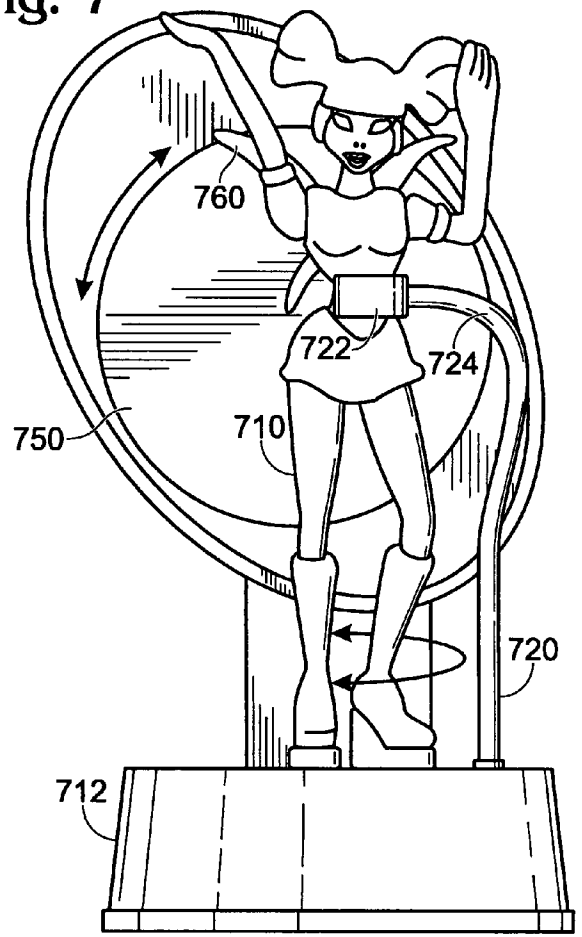
FIG. 7 shows a front view of a third example figure and stand with the figure coupled to the stand.

Referring now specifically to FIGS. 7, a third example embodiment of a doll 710 and stand 712 is described. This embodiment is similar to the second example, in that a post 720 with a c-shaped member 722 is used to removably attach the doll to the stand. In this example, actuation by the user of a tab in the rear of the stand generates rotation of the doll on the stand (as shown by the arrow), and rotations of the rear circular panel 750 (as shown by the arrow). Also, in the example, post 720 has a bend 724.

As previously described above, the stand 712 provides rotary motion to rotate the doll 710 and post 720, along with coordinated motion of the back panel of the stand via panel 750. Specifically, as shown by FIG. 7 (and the arrows in FIG. 7), the circular panel 750 rotates with the rotating motion of the figure 710. In this example, the figure makes a single rotation of 360 degrees about a vertical axis, while the back panel also rotates 360 degrees. However, more or less rotation of each member, as well as different amounts of rotation between the two members, can be used. Again, as noted above, the doll may have various rotary joints, wings (removable or permanently affixed) 760, and can include any and all of the features described in U.S. Provisional Patent Application No. 60/538,444, forwarded on Jan. 7, 2004, titled DOLL, naming Jon C. Marine, Mark S. Wittenberg, and Debbie Glassberg as inventors.

Figure 8:
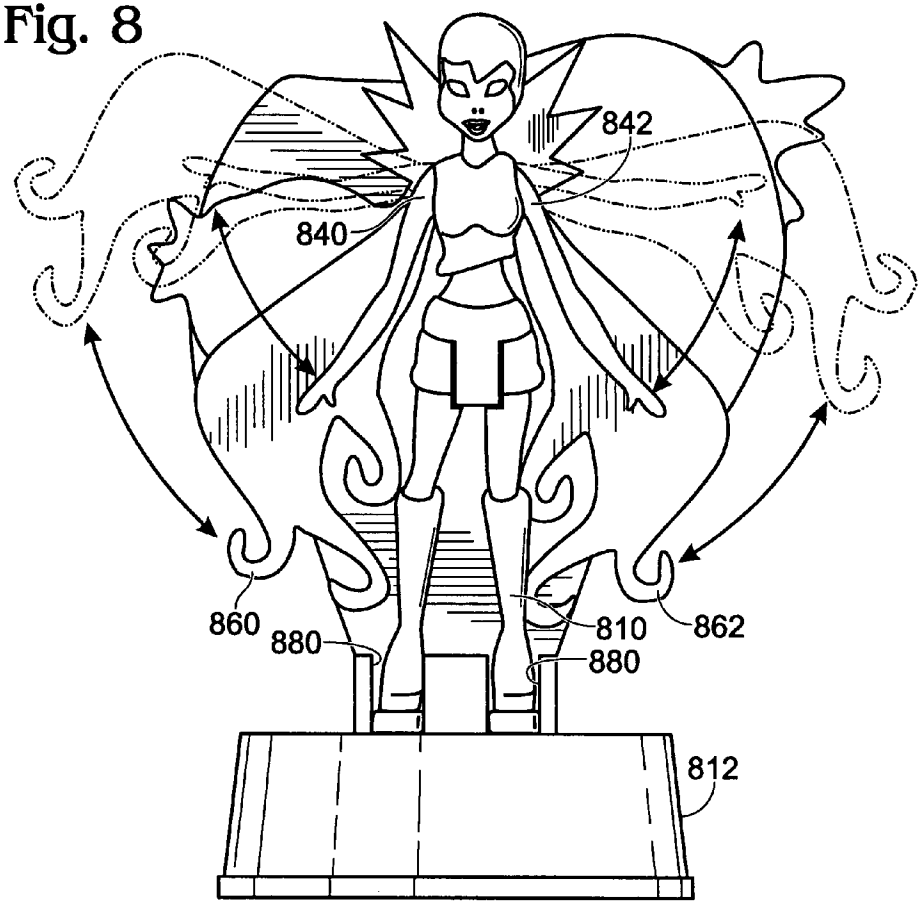
FIG. 8 shows a front view of a fourth example figure and stand with the figure coupled to the stand.

Referring now specifically to FIG. 8, a fourth example embodiment of a doll 810. and stand 812 is described, which stand is similar to that described with regard to the above Figures, and which doll has an internal mechanism similar to that described with regard to FIGS. 1-4. The doll 810 may be removably attached to the stand via two foot pegs (one for each foot, 830, see FIG. 9) and a motion peg protruding from the back, as described herein above with regard to FIGS. 1-4, for example (see also FIG. 9). FIG. 8 shows a front view of the doll 810 removably attached to the stand via the foot pegs and back peg. The doll may be made from hard plastic, with a singe degree of freedom rotary arms 840 and 842, neck, waist, and hip/leg joints, allowing a user to create various positions. Further, the doll 810 may have plastic hair 860 mounted to an internal mechanism in the doll to translate up and down vertical motion of the back peg into rotary motion of left and right sections of the hair.

Motion generated by a tab in the back of the stand may also be translated into up and down motion of a mating peg to the back leg of the doll. In one example, the tab in the back of the stand may be actuated by a user to initiate coordinated motion of the dolls left and right hair sections (860 and 862), and optionally the left and right arms (840 and 842).

The doll 810 may have hard plastic hair, and may have moveable or bendable legs and hip joints. Further, the doll 810 may have permanently attached, or removable wings. In one example, the doll may include any and each of the features of the examples described in U.S. Provisional Patent Application No. 60/538,444, forwarded on Jan. 7, 2004, titled DOLL, naming Jon C. Marine, Mark S. Wittenberg, and Debbie Glassberg as inventors, the entire contents of which are incorporated herein by reference in their entirety.

Figure 9:
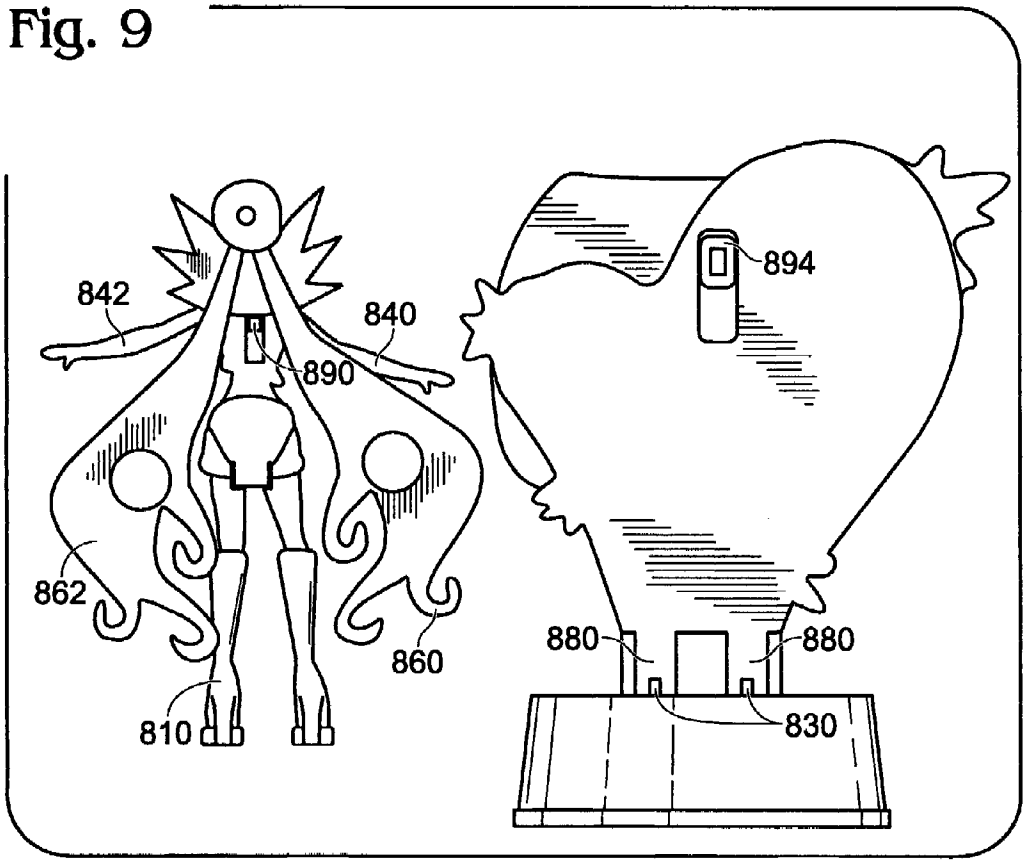
FIG. 9 shows a front view of the fourth example stand and a rear view of the fourth example figure.

Referring now to FIG. 9, a rear view of doll 810 and front view of stand 812 is shown. As described above and shown in FIG. 9, in one example, the doll 810 and stand 812 may be coupled to translate up and/or down motion via a mating female peg 894 in the stand 812 and a corresponding male peg 890 in the doll 810. Specifically, up and/or down motion female peg 894 generates up and/or down motion in peg 890, and then internal mechanisms in doll 810 transfer motion of peg 890 into up and/or down motion of the hair and/or arms as shown by the arrows in FIG. 8. Further, stand 812 may have two foot pegs 830 located in its base in the cutaway sections 880 in the rear portion of the base of the stand.

As noted above, upon actuation by a user, the hair sections 860 and 862 and arm sections 840 and 842 raise and lower in a coordinated manner in a single up and down motion over about 5 seconds, although multiple up and down motions could be used, if desired. Further, slower or faster movement could also be used, as well as independent motion between the arm and hair sections.

Figure 10:
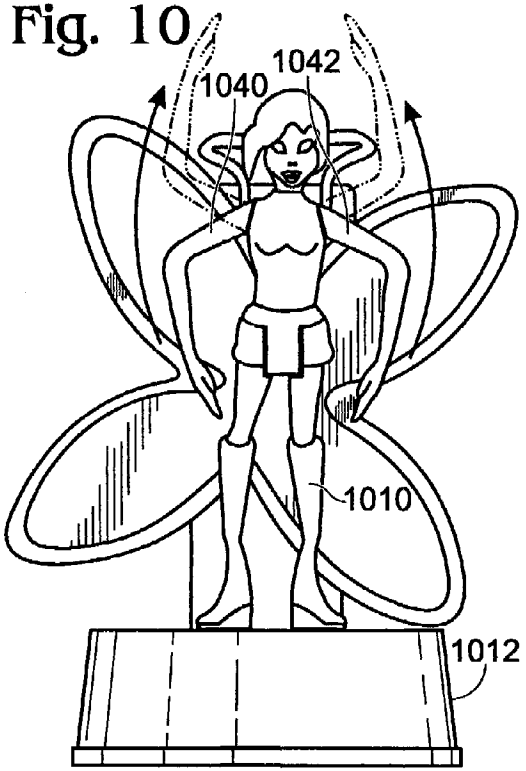
FIG. 10 shows a front view of a fifth example figure and stand with the figure coupled to the stand.

Referring now specifically to FIGS. 10, a fifth example embodiment of a doll 1010 and stand 1012 is described, which stand is similar to that described with, and which doll 1010 may have an internal mechanism similar to that described with regard to FIGS. 5-6 and 8-9, for example. The doll 1010 may be removably attached to the stand 1012 via two foot pegs (one for each foot, not shown) and a motion peg protruding from the back. FIG. 10 shows a front view of the doll 1010 removably attached to the stand 1012 via the foot pegs and back peg. The doll 1010 may be made from hard plastic, with a singe degree of freedom rotary, neck, waist, and hip/leg joints, allowing a user to create various positions. Further, the doll has both the left and right arms 1040, 1042 an internal mechanism in the doll to translate up and down vertical motion (such as up and/or down motion) of the back peg into rotary motion of left and right arms, as shown by the arrows.

Thus, rather than providing motion of a left and right section of hair, the FIG. 1010 provides up and down motion of the left and right arms 1040 and 1042. Other features of the stand and figure are similar to those described above.

Again, as noted above, the doll has various rotary joints, wings (removable or permanently affixed), and can include any and all of the features described in U.S. Provisional Patent Application No. 60/538,444, forwarded on Jan. 7, 2004, titled DOLL, naming Jon C. Marine, Mark S. Wittenberg, and Debbie Glassberg as inventors.

In the example of doll 1010 and stand 1012, progressive motion of the doll may be generated via actuation by a user's hand.

Note that the motion of any of the dolls/stands described above can be of various durations, such as, for example, on the order of 1-3 seconds, 2-5 seconds, 3-6 seconds, less than or greater than: 1 second, 2 seconds, 3 seconds 4 seconds, 5 seconds, 6 second, 7 seconds, 8 seconds, 9 seconds, and/or shorter, and/or longer.

As described in the examples above, the user input which activates the doll and/or stand motion may be a user pressing the tab on the back of the stand. However, in alternative embodiments, the input can be the depression of a button on the doll by a user, a radio signal, the presence of a figure or figurine in proximity to the house or playset, a voice command, or a specific position relative to the house or playset (e.g., proximity to a front door), or various other inputs.

Note that the stands and the dolls of various of the above Figures may be interchanged, such as those of FIGS. 1, 8, 9, and/or 10. Likewise, the stand and the dolls of FIGS. 5 and 7 may be interchanged.

It is believed that the disclosure set forth above encompasses multiple distinct examples with independent utility. While each of these examples has been disclosed in example form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of claims in a related application. Such new claims, whether they are directed to a different invention or directed to the same invention, whether different, broader, narrower or equal in scope to the original claims, are also regarded as included within the subject matter of the inventions of the present disclosure.

The invention claimed is:

1. A stand configured to be removably coupled to a doll, the stand comprising:

a base portion with a vertical back extending therefrom, the vertical back including a stationary panel and a moveable panel that includes decorative indicia and a rotating feature;

a moveable input receiving device positioned on the back and configured to receive input from a user, the device being configured for movement relative to the stand;

an energy storage element coupled to said moveable input receiving device to store energy imparted from said user;

a moveable element mounted to said stand, configured for movement relative to the stand, coupled to said energy storage element, that is actuated by said stored energy upon a release of said moveable input receiving device by said user, said moveable element configured to be removably coupled to the doll to actuate motion of the doll and motion of the moveable panel to move the decorative indicia relative to the stationary panel, wherein such movement of the decorative indicia is coordinated with motion of the doll, and wherein no motion of the stand or doll occurs during actuation of the input receiving device by the user.

2. The stand of claim 1 wherein said energy storage element includes a spring, and wherein said motion of the doll includes rotating the doll upon said release.

3. The stand of claim 1 further comprising a speed governor is coupled to said energy storage element to provide regulated release of said stored energy to actuate the moveable element.

4. The stand of claim 3 wherein said energy storage element includes a spring, and said motion of the doll includes motion of a part of the doll.

5. A product, comprising:

a doll configured to be removably coupled to a stand, the doll comprising:

a moveable human feature; and a moveable motion receiving device coupled to said moveable human feature via a motion translation mechanism, said moveable motion receiving device translating input motion to said moveable human feature through said motion translation mechanism, and a stand configured to be removably coupled to a doll, the stand comprising:

a base portion with a vertical back extending therefrom, the vertical back including a stationary panel and a moveable panel that includes decorative indicia, the stationary panel further including a cutaway portion with which the decorative indicia may be aligned such that the decorative indicia is temporarily revealed;

a moveable input receiving device positioned on the back and configured to receive an input from a user;

an energy storage element coupled to said moveable input receiving device to store energy imparted from said user; and a moveable element of said stand coupled to said energy storage element that is actuated by said stored energy upon a release of said moveable input receiving device by said user, said moveable element configured to be removably coupled to the doll, and to generate said input motion to actuate and coordinate motion of the moveable human feature and motion of the moveable panel to move the decorative indicia relative to the stationary panel.

6. The product of claim 5 wherein said moveable panel includes a rotating feature.

7. The product of claim 6 wherein said rotating feature includes a rotating star.

8. The product of claim 5 wherein said human feature includes wings.

9. A stand configured to be removably coupled to a doll, the stand comprising:

a base portion with a vertical back extending therefrom, the vertical back including a stationary panel and a moveable panel that includes decorative indicia, the stationary panel further including a cutaway portion with which the decorative indicia may be aligned such that the decorative indicia is temporarily revealed;

a moveable input receiving device positioned on the back and configured to receive input from a user, the device being configured for movement relative to the stand;

an energy storage element coupled to said moveable input receiving device to store energy imparted from said user;

a moveable element mounted to said stand, configured for movement relative to the stand, coupled to said energy storage element, that is actuated by said stored energy upon a release of said moveable input receiving device by said user, said moveable element configured to be removably coupled to a doll to actuate motion of the doll and motion of the moveable panel to move the decorative indicia relative to the stationary panel.

* * * * *